US006278103B1

(12) United States Patent
Takami

(10) Patent No.: US 6,278,103 B1
(45) **Date of Patent: *Aug. 21, 2001**

(54) CHARGING APPARATUS WHICH CONTROLS OSCILLATING COMPONENT TO STABILIZE CURRENT

(75) Inventor: Hiroshi Takami, Odawara (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/312,846

(22) Filed: May 17, 1999

(30) Foreign Application Priority Data

May 15, 1998 (JP) ..... 10-152005

(51) Int. Cl.[7] ..... H01J 40/14
(52) U.S. Cl. ..... 250/214 R; 363/21
(58) Field of Search ..... 250/214 R, 214 P, 250/214 AG, 208.1; 363/19, 21, 50; 327/520, 548, 592; 358/298, 504

(56) References Cited

U.S. PATENT DOCUMENTS 4,731,721 * 3/1988 Igashira et al. ..... 363/56

FOREIGN PATENT DOCUMENTS 63-149668 6/1988 (JP) .

* cited by examiner

*Primary Examiner*—Que T. Le
(74) *Attorney, Agent, or Firm*—Fitzpatrick, Cella, Harper & Scinto

(57) ABSTRACT

A charging apparatus includes a charging member for charging a member to be charged; voltage application means for applying an oscillating voltage to the charging member; current detecting means for detecting an electric currant flowing through the charging member; time detecting means for detecting time during which an output level of the current detecting means; and voltage control means for controlling an oscillating component of the voltage applied to the charging member on the basis of an output of the time detecting means.

8 Claims, 11 Drawing Sheets

CHARGING APPARATUS WHICH CONTROLS OSCILLATING COMPONENT TO STABILIZE CURRENT

FIELD OF THE INVENTION AND RELATED ART

The present invention relates to a charging apparatus, the charging member of which is placed in contact with, or placed microscopically close to, an object to be charged, for example, a photosensitive member or the like, in order to charge the object. In particular, it relates to a charging apparatus which applies to its charging member a voltage comprising an oscillating component.

In the past, a corona discharging apparatus (corona type charging device) has been widely used as a means for charging an object such as a photosensitive member in an image forming apparatus (copying machine, laser printer, and the like) which employed, for example, an electrophotographic process A corona discharging apparatus is a noncontact type charging apparatus. It comprises a charging electrode constituted of a piece of wire or the like, and a shield electrode which surrounds the discharging electrode. The shield electrode is provided with a corona discharging opening directed toward the surface of an object to be charged, not in contact with the object. In operation, a high voltage is applied to the discharging electrode and the shield electrode to generate discharge current (corona shower) to which the surface of the object is exposed to be charged to predetermined polarity and potential level.

In recent years, however, a contact type charging apparatus has been put to practical use. In the case of contact type charging apparatus, the electrically conductive charging member of a contact type charging apparatus, to which a voltage is being applied, is placed in contact with an object to be charged, in order to charge the surface of the object to predetermined polarity and potential level. In charging an object with the use of a contact type charging apparatus, two distinctive charging systems (mechanisms or principles) play mixed roles. One is an electrical discharge based charging system, or mechanism. According to an electrical discharge based charging system, the surface of an object to be charged is charged by an electrical discharge which occurs through microscopic gaps between a charging member and the object to be charged. The other is a charge injection based system, or mechanism, according to which electrical charge is directly injected from a charging member into an object to be charged to charge the surface of the object. Thus, the characteristic of a contact type charging apparatus varies depending on which of the two systems is dominant in charging an object.

An electrically conductive charging member may vary in shape and material. For example, it may be of a roller type, a blade type, a fur brush type, or a magnetic brush type.

There are two systems for applying voltage to a charging member. There are a DC application system which applies only a DC voltage to a charging maser, and an AC application system which applies an oscillating voltage (voltage, value of which periodically changes) to a charging member. Regarding an AC application system, applying to an object to be charged, a compound oscillating voltage composed of an AC voltage Vac with a peak-to-peak voltage, the level of which is twice or more the level of the threshold voltage required to charge an object by applying DC voltage to the object, is effective to uniformly charge the object; the object can be more uniformly charged by this type of AC application system than a DC application system (Japanese Laid-Open Application No. 149668/1988).

It is not mandatory that a charging member be placed in contact with the surface of an object to be charged, with the application of a certain amount of contact pressure, as long as it is assured that a region in which electrical discharge is allowed to occur is provided between the charging member and the object to be charged. In other words, a charging member and an object to be charged do not need to be placed in contact with each other as long as they are disposed extremely close to each other, that is, close enough to trigger electrical discharge between them. In the case of the present invention, a charging system based on such an arrangement between a charging member and an object to be charged is included in the category of a contact type charging apparatus. Whether or not electrical discharge occurs is determined by the voltage across the gap between the charging member and the object to be charged, and Paschen curve.

The latter charging system, the contact type charging system, has many advantages over the former charging system, a corona discharging apparatus. For example, (1) it is unnecessary to apply bias constituted of high voltage, (2) charging efficiency in high, (3) the amount of the products such as ozone for which the discharging of corona is responsible is extremely small, and (4) there is no problem that the wire is soiled.

However, a contact type charging apparatus suffers from its own problems. That is, the electrical resistance or electrostatic capacity of the resistive layer of a charging member fluctuates in response to ambient factors, in particular, temperature and humidity, and as a result, leak or charge failure occurs.

Generally, in order to solve these problems peculiar to a contact type charging apparatus of an AC application type, compensation is automatically made for the fluctuation of the electrical resistance of the resistive layer of a charging member, which is caused by the ambient factors, by controlling the AC voltage, that is, the oscillating component of the oscillating voltage applied to the charging member, so that the current through the charging member remains stable.

Here, such a method will be briefly described. Referring to FIG. 12, a referential character 1 designates an object to be charged. In this example of an electrophotographic image forming apparatus, the object to be charged is an electrophotographic photosensitive member in the form of a rotative drum (hereinafter, "photosensitive drum"). A referential character 2 designates a contact type charging member, which is disposed in contact with the photosensitive drum 1. In this example, the contact type charging member is constituted of an electrically conductive member of a roller type (hereinafter, "charge roller"). The charge roller 2 consists of an electrically conductive metallic core 2*a*, an electrically conductive elastic layer 2*b* concentrically formed on the peripheral surface of the metallic core 2*a*, and an electrically resistive layer 2*c* coated on the peripheral surface of the conductive elastic layer 2*b*. A referential character S designates a high voltage power source (bias application power source) for the charge roller 2. From this power source S, a compound oscillating voltage compound of a DC voltage Vdc and an AC voltage Vac is applied to the charge roller 2 through the metallic core 2*a*. As a result, the peripheral surface of the photosensitive drum 1 is uniformly charged to predetermined polarity and potential level.

FIG. 13 depicts an example of an electrical circuit for controlling the AC voltage, or the oscillating component, of the oscillating voltage applied to the charge roller 2, so that the current through the charge roller remains stable. A referential character 11 designates an oscillating deice (oscillating circuit), from which a voltage with a rectangular wave-form having the same frequency as that of the AC voltage applied to the charge roller 2 is outputted. The outputted voltage with the rectangular wave-form is amplified by an amplifying device 12, converted into a voltage with a sinusoidal wave-form as it is passed through a low-pass filter 13, and inputted into a transformer driving circuit 14. The transformer driving circuit 14 applies the voltage with the sinusoidal wave-form to the primary coil of a step-up transformer 15. As a result, a high voltage with the sinusoidal wave-form is generated at one end (coil end 3) of the secondary coil, and is outputted through resistors 16 and 17, and a condenser 18; the AC voltage Vac is applied to the charge roller 2.

On the other hand, to the other end (coil end 4) of the secondary coil of the step-up transformer 15, a high voltage DC power source 19 is connected. From this power source 19, a predetermined DC voltage Vdc is applied, along with the aforementioned AC voltage Vac, to the charge roller 2 through the secondary coil of the step-up transformer, the resistors 16 and 17, and the condenser 18.

The same end (coil end 4) of the secondary coil of the step-up transformer 15 is connected to a peak voltage detection circuit 21 through a condenser 20. The AC current 1, which flows on the secondary side of the step-up transformer 15 is coupled by the condenser 20, and then is flowed to GND through the current detection resistor 22. As the current flows through the current detection resistor 22, the voltage with the sinusoidal wave-form, the level of which is proportional to the level of the current which flows through the secondary coil, is generated at one end of the resistor 22. The peak voltage detection circuit 21 is a circuit which detects the peak value of the voltage with the sinusoidal wave-form generated at the resistor 22, and the detected peak voltage value is inputted into a comparator circuit 23, which compares the output value Vp of the peak voltage detection circuit 21 to the predetermined voltage level Vref of a referential power source 24, and adjusts the output of an amplifier 12 in response to the results of the comparison, so that the output value Vp becomes equal to the predetermined voltage level Vref.

With such a control as described above, the peak value of the AC current which flows through the secondary coil of the step-up transformer 15, in other words, the peak value of the AC current which flows into the charge roller 2, remains stable However, in the case of a method in which the AC current which flows through the charge roller as the charging member is kept stable by controlling the peak value of the AC current which flows through the charge roller, the effective value of the current which flows through the charge roller becomes greater when there is a deformation in the wave-form of the current which flows through the charge roller than when there is no deformation. Thus, this method suffered from a problem that an object to be charged was insufficiently charged, or the surface layer of the photosensitive drum 1 as the object to be charged was shaved by a substantial amount.

The characteristics, in particular, the impedance related characteristics, of a charge roller change in response to ambience, usage time, soiling by toner, or the like factors. As such changes occur, the way the current wave-form deforms also changes. Consequently, the effective value of the current which flows through the charge roller changes, which creates a problem.

FIG. 14 is an example of the deformation of the current wave-form. When a voltage with a sinusoidal wave-form is applied to a charge roller, if the impedance of a charge roller remains stable regardless of the level of the voltage applied to the charge roller, the current wave-form becomes a wave-form (a), or a perfect sinusoidal curve On the contrary, when the impedance of a charge roller fluctuates in response to the level of the voltage applied to the charge roller, the current wave-form becomes a wave-form (b), or a deformed sinusoidal curve.

In the case of a conventional method for keeping stable the current through a charge roller, control Is executed so that the peak value Vp of the current remains stable Therefore, the effective value of the current with the wave-form (b) with deformation is greater than that of the current with the wave-form (a) with no deformation.

SUMMARY OF THE INVENTION

The primary object of the present invention is to provide a charging apparatus in which the effective value of the current which flows through the charging member is prevented from being fluctuated by the deformation of the current wave-form.

Another object of the present invention is to provide a charging apparatus which is prevented from insufficiently charging an object.

Another object of the present invention is to provide a charging apparatus which shaves the surface of an object to be charged by a substantially smaller amount than a conventional charging apparatus.

According to an aspect of the present invention, a charging apparatus comprises: a charging member for charging an object; a voltage applying means for applying oscillating voltage to the charging member; a current detecting means for detecting the current which flows through the charging member; a duration detecting means for detecting the length of time during which the value of the output detected by the current detecting means is equal or above a predetermined value; and a voltage controlling means for controlling the oscillating component of the voltage applied to the charging member, in response to the value of the output of the duration detecting means.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1 (FIGS. 1–6)

(1) Example of Image Forming Apparatus

Figure 1:
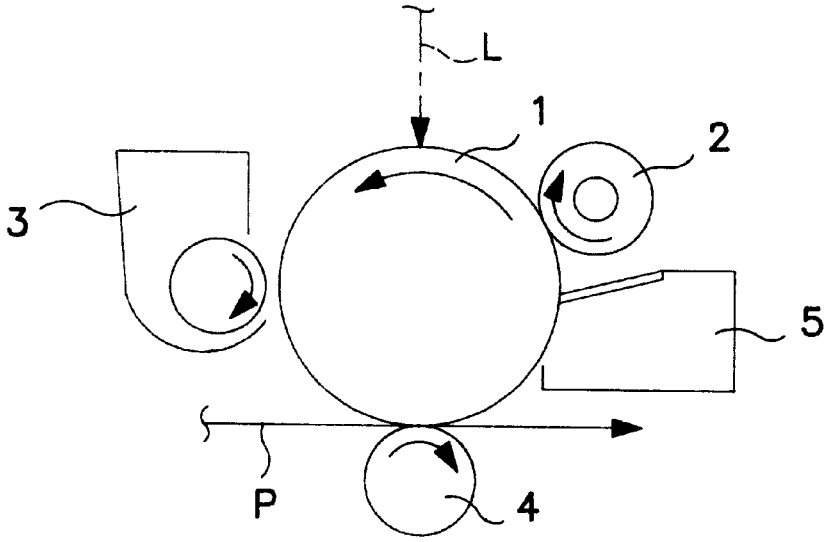
FIG. 1 is a schematic drawing which depicts the general structure of the image forming apparatus in the first embodiment of the present invention.
Figure 2:
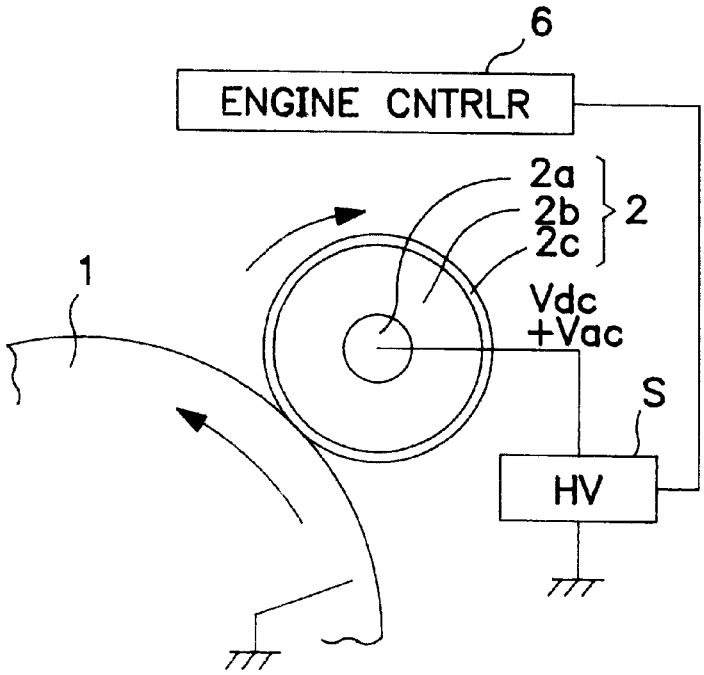
FIG. 2 is an enlarged schematic drawing of the charge roller and the adjacencies thereof.

FIG. 1 is a schematic drawing which depicts the general structure of the image forming apparatus in the first embodiment. FIG. 2 is an enlarged schematic drawing of the charge roller and its adjacencies. The image forming apparatus in this embodiment is a transfer type electrophotographic apparatus (copying machine, printer, facsimile, and the like) which employs a contact type charging apparatus.

A referential character 1 designates an electrophotographic photosensitive drum (photosensitive drum), as an object (image bearing member) to be charged, in the form of a rotative drum This photosensitive drum 1 is rotatively driven in the counterclockwise direction indicated by an arrow mark at a predetermined peripheral velocity (process speed).

The photosensitive drum 1 is uniformly charged to predetermined polarity and potential by a contact type charging member 2 (contact type charging device) as it is rotated.

Figure 12:
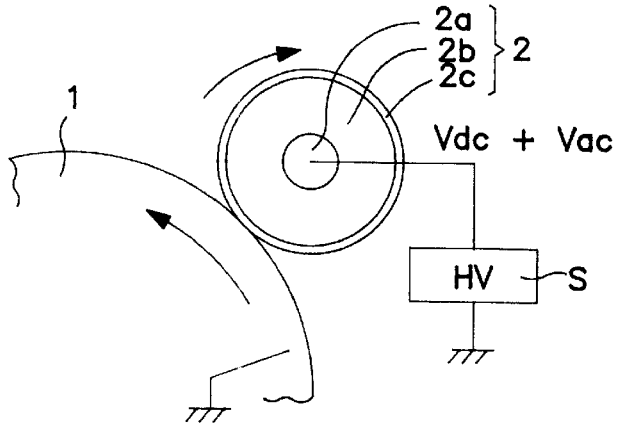
FIG. 12 is a schematic drawing of an example of a contact type charging apparatus (charging apparatus of roller type).

The contact type charging member 2 is constituted of a charge roller (roller type charging device), and comprises an electrically conductive metallic core 2*a*, an electrically conductive elastic layer 2*b*, and a resistive layer 2*c*, as does the aforementioned charge roller 2 illustrated in FIG. 12. The apparatus is configured so that this charge roller 2 rotates by following the rotation of the photosensitive drum 1. The charge roller 2 may be rotated in the same direction as the rotational direction of the photosensitive drum 1, or may be rotatively driven in the direction opposite to the rotational direction of the photosensitive drum 1, independently from the photosensitive drum 1.

The conductive elastic layer 2*b* of the charge roller 2 is formed of, for example, silicon rubber in which electrically conductive carbon particles are dispersed to adjust the electrical resistance of the rubber (reduced to $10^4$ ohm.cm or lower). It plays a role in stabilizing the nip formed by the charge roller 2 and the photosensitive drum 1.

The resistive layer 2*c* is formed of epichlorohydrine, urethane, EPDM, or nylon. Regarding the resistance value of the resistive layer 2*c*, in the case of epichlorohydrine, its intrinsic resistivity is acceptable as it is, whereas in the case of the latter three materials, carbon particles or the like are dispersed in them to adjust their resistivity ($10^7$–$10^{11}$ ohm.cm with a thickness of 80–100 $\mu$m). This layer plays a role in preventing charge from leaking to the photosensitive drum 1 and also in preventing the plasticizer from leaking out from the rubber layer thereunder.

Both the conductive elastic layer 2*b* and resistive layer 2*c* may be constituted of two or more sub-layers.

The photosensitive drum 1 is exposed to an exposing light L projected from an unillustrated exposing apparatus (means for projecting image of original upon photosensitive drum 1; laser based scanning means; or the like). As a result, the uniform charge on the peripheral surface of the photosensitive drum 1 is removed from the selected across correspondent to the pattern cast on the surface by the exposing means (potential is attenuated); an electrostatic latent image is formed on the peripheral surface of the photosensitive drum 1.

The thus formed electrostatic latent image is developed into a visible image formed of toner (hereinafter, "toner image") by a developing apparatus.

Meanwhile, a piece of recording medium P (transfer medium) is fed out of an unillustrated sheet feeding apparatus, and then is fed into a transfer station between the photosensitive drum 1 and the transfer roller 4 with a predetermined timing. In the transfer station, the toner image on the peripheral surface of the photosensitive drum 1 is transferred onto the surface of the recording medium P, starting from the downstream side of the image in terms of the rotational direction of the photosensitive drum.

After the toner image is transferred onto the recording medium P, the recording medium P is separated from the peripheral surface of the rotating photosensitive drum 1, and is introduced into an unillustrated fixing apparatus, in which the toner image is fixed to the recording medium P. Thereafter, the recording medium P is outputted as a copy or a print.

After the separation of the print from the photosensitive drum 1, the toner which is remaining on the peripheral surface of the rotating photosensitive drum 1 is removed by the cleaning apparatus 5, and the photosensitive drum 1 is used for the next image formation.

Referring to FIG. 2, a referential character 6 designates the engine controller of the image forming apparatus. The engine controller comprises a CPU, a ROM, a RAM, a clock signal generating circuit, a motor control circuit, a heater temperature control circuit, an image controlling circuit, and the like (none of above are illustrated).

A high voltage power source S applies a compound bias (oscillating voltage) composed of a DC voltage Vdc and an AC voltage Vac, to the charge roller 2 through the metallic core 2*a*. This high voltage power source S also is controlled by the aforementioned engine controller.

(2) AC Voltage Control Circuit

In this embodiment, the AC voltage applied to the charge roller 2 is controlled so that the current generated by the AC voltage remain stable.

Figure 3:
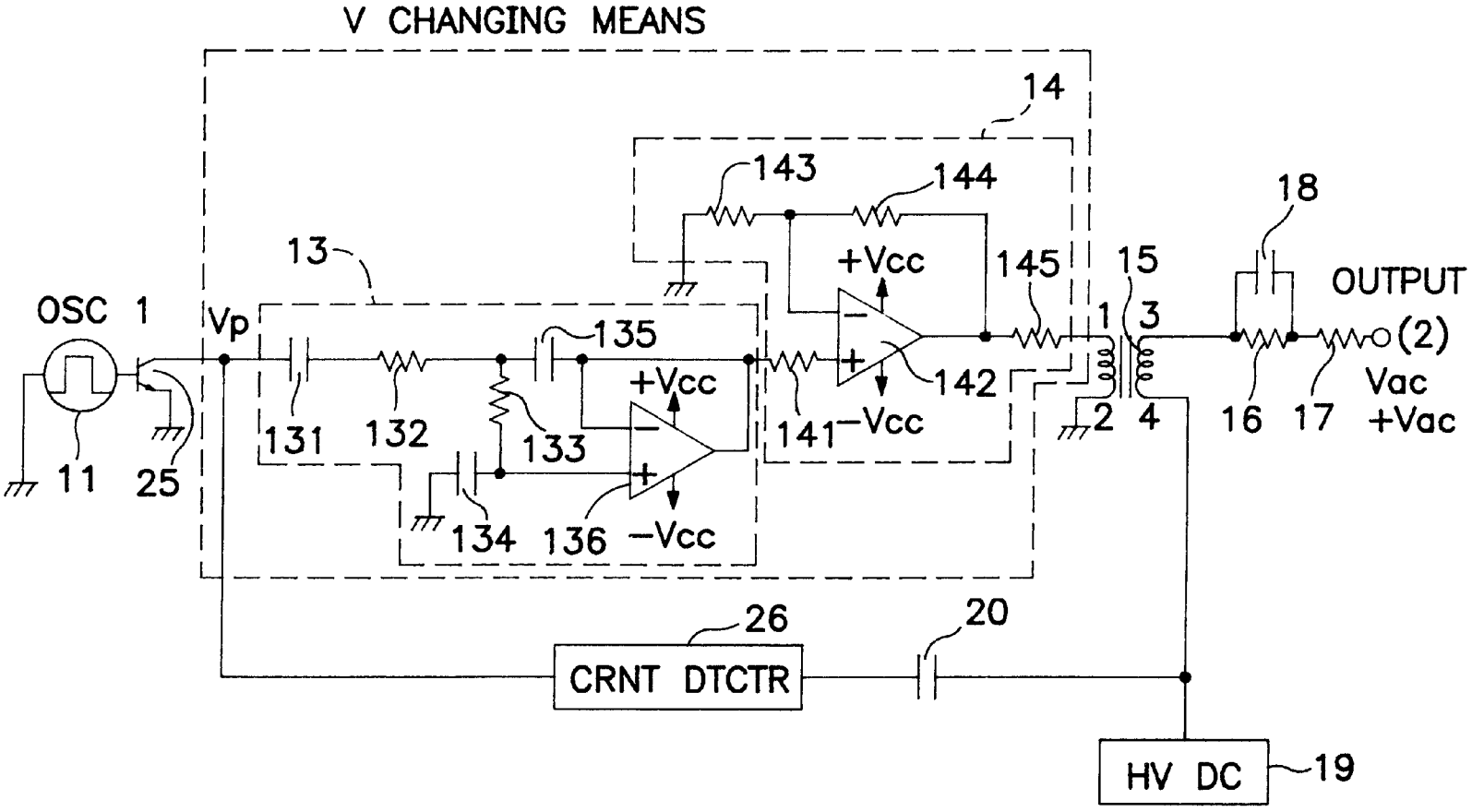
FIG. 3 is a diagram of the circuit for controlling the AC voltage applied to the charging roller.
Figure 13:
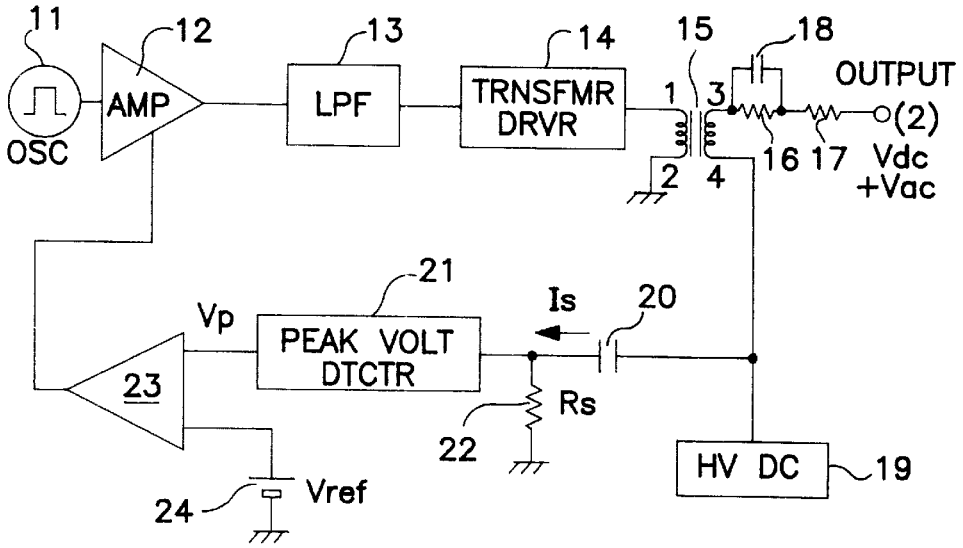
FIG. 13 is a block diagram of an example of a circuit for controlling the AC voltage, that is, the oscillating component, of the oscillating voltage applied to a charge roller, so that the current through a charging member remains stable.
Figure 14:
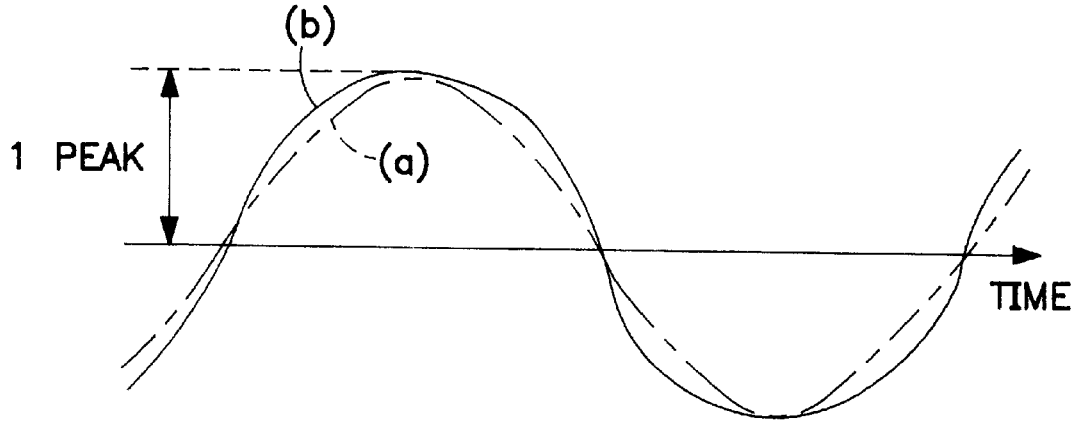
FIG. 14 is a drawing which depicts the deformation of a current wave-form.

FIG. 3 is a control circuit for controlling the AC voltage applied to the charge roller 2. In this drawing, the same structural members and portions as those in the control circuit illustrated in FIG. 13 are correspondingly given the same referential characters as those in FIG. 13.

An oscillator (oscillation circuit) 11 (OSC1) sends out a voltage with a rectangular wave-form having the same frequency as that of the AC voltage applied to the charge roller 2. The apparatus may be configured so that the voltage with the rectangular wave-form is generated by the clock signal generation circuit within the engine controller, and sent out to the high voltage power source.

The outputted voltage with the rectangular wave-form is passed through a transistor 25 and the low-pass filter 13, being converted into a voltage with a sinusoidal wave-form. The low-pass filter 13 consists of condensers 131, 134 and 135, resistors 132 and 133, and an operational amplifier 136.

The thus formed voltage with the sinusoidal wave-form is inputted into a transformer driving circuit 14 (transformer driver). The transfer driving circuit 14 comprises an operational amplifier 142, and resistors 141, 143, 144 and 145 which are adjacent to the amplifier 142.

The transformer driving circuit 14 applies the voltage with the sinusoidal wave-form to the primary coil of the step-up transformer 15. As a result, a high voltage with the sinusoidal wave-form is generated in the secondary coil of the step-up transformer 15. This high voltage with the sinusoidal wave-form is outputted from the one end (terminal 3) of the secondary coil of the step-up transformer 15 through resistors 16 and 17, and the condenser 18. As a result, the AC voltage Vac is applied to the charge roller 2.

On the other hand, to the other end (terminal 4) of the secondary coil of the step-up transformer 15, a high voltage DC power source 19 is connected. From this power source 19, a DC voltage Vdc with a predetermined level is applied, along with the aforementioned AC voltage Vac, to the charge roller 2 through the secondary coil of the step-up transformer 15, the resistors 16 and 17, and the condenser 18.

The end (terminal 4) of the secondary coil of the step-up transformer 15 is also connected to a current detection circuit 26 (current detection portion) through a condenser 20.

The current detection circuit 26 detects the value of the inputted current, and outputs a voltage, the level of which is proportional to the detected value.

An operational amplifier 27 outputs a voltage proportional to the voltage outputted by the current detection circuit 26 to adjust the amplitude of the voltage with the rectangular wave-form sent to the low-pass filter 13.

With the above described control, the current value in the secondary coil of the step-up transformer 15 can be stabilized; the current which flows through the charge roller 2 can be stabilized at a predetermined level.

Next, the current detection circuit 26 will be described in detail with reference to the circuit diagram in FIG. 4 and the time chart in FIG. 5.

The AC current $I_s$ inputted into the current detection circuit 26 is converted into an AC voltage V1 by resistors 261 and 262.

The AC voltage V1 Is compared to predetermined referential DC voltage $V_{ref1}$ and $V_{ref2}$, and converted into a detection voltage V2, by comparators 263 and 264.

At this time, the operation of the comparators will be described. When the comparator is off, the output of the comparator is at a ground level, and when the comparator is on, the output of the comparator is in the ON state. In the case of this circuit, the comparator 263 is in the ON state when $V1>V_{ref2}$, whereas the comparator 264 is in the ON state when $V1<V_{ref1}$. When the comparators 263 and 264 are in the ON state, the detection voltage vα is at the High level. Therefore, under the following conditions, the detection voltage Vα remains at the Low level.

$V1>V_{ref1}$, or $V1<V_{ref2}$.

Figure 5A:
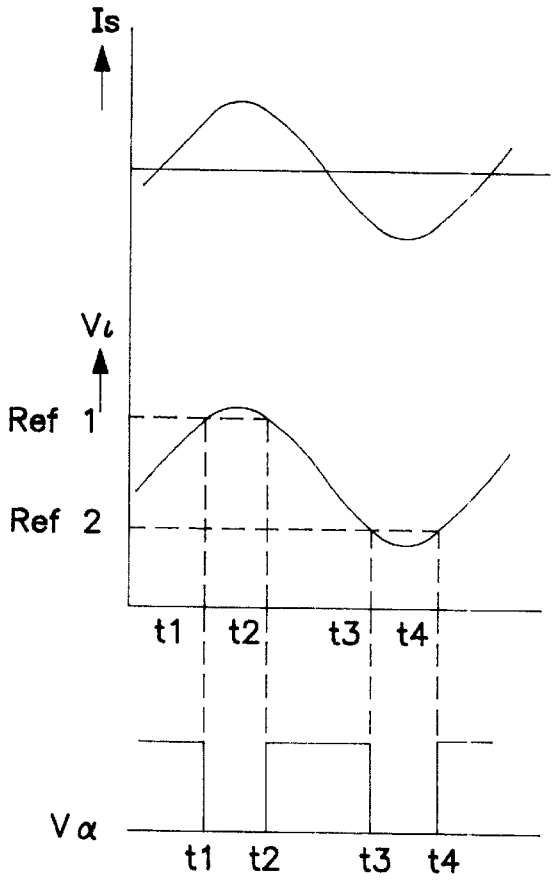
FIGS. 5(A–B) is a time chart for the current detection circuit.
Figure 5B:
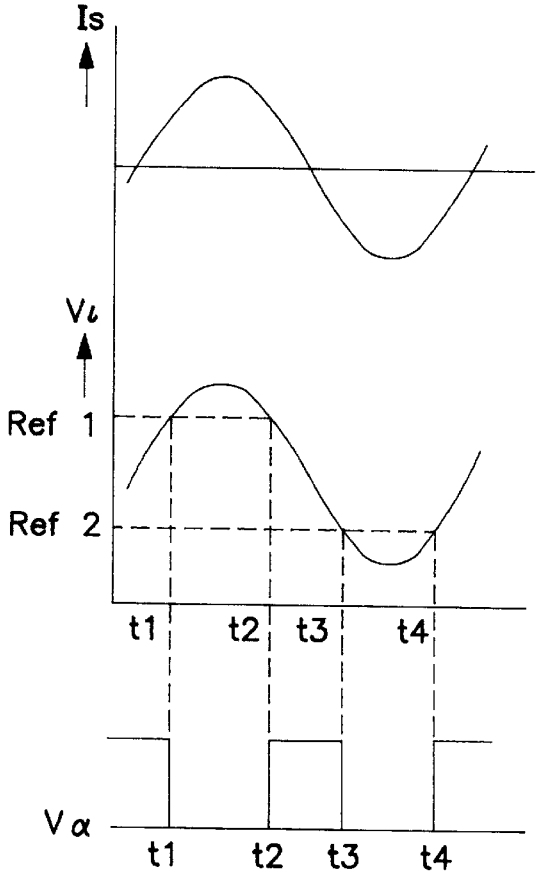

Referring to the time chart in FIG. 5, in the case of a chart (a), it is during a period t1–t2 and a period t3–t4 when the detection voltage Vα remains at the LOW level.

A time chart (b) represents a case in which an AC current greater than that inputted in the case represented by the time chart (a) was inputted.

As is evident from these charts, the length of the period in which the detection voltage pulse Vα remains at the Low level increases as the current value increases.

In this embodiment, the output voltage is controlled in response to the results of the comparison of the duty ratio of this detection voltage pulse Vα to the duty ratio of the referential pulse, so that the current through the charge roller 2 remains stable.

Next, a circuit for comparing the duty ratio of this detection voltage pulse Vα to that of the referential pulse Vβ will be described. In FIG. 4, a transistor 268, a resistor 270, and a diode 267 constitute a charging circuit for flowing a current $I_1$ into a condenser 276. The total of the base/emitter voltage of the transistor 268 and the voltage generated between the transistor 268 and resistor 270 by the current $I_1$ is kept at the same level as the level of the forward voltage of the diode 267. Therefore, the amount of the current $I_1$ is limited by the transistor 268 to a predetermined level.

On the other hand, a transistor 269, a resistor 271, a diode 266, a transistor 272, a resistor 275, and a diode 274 constitute a discharge circuit which discharges the electrical charge accumulated in the condenser 276, generating currents $I_2$ and $I_3$.

When the detection pulse voltage Vα is in the High state, the transistor 269 is also in the ON state, allowing the constant current $I_2$ to flow as does the aforementioned charging circuit constituted of the transistor 268, resistor 270, and diode 267.

On the other hand, when the detection pulse voltage Vα goes into in the Low state, the transistor 269 is turned off, and therefore, the current $I_2$ does not flow.

Similarly, the transistor 272 is driven by the referential pulse Vβ. In other words, when the referential pulse Vβ goes into the state of High, the transistor 272 is turned on, allowing the constant current $I_3$ to flow. The referential pulse Vβ is a voltage with a rectangular wave-form sent out by an oscillator 278.

The charging apparatus may be configured so that the referential pulse Vβ is generated by the clock generation circuit in the engine controller 6 (FIG. 2), and sent to the high voltage power source.

By correspondingly matching the characteristics of the transistors 268, 269 and 272, the characteristics of the resistors 270, 271 and 275, and the characteristics of the diodes 266, 267 and 274, the values of the current $I_1$, $I_2$and $I_3$ become the same. In this case, the voltage Vd of the condenser 276, which is charged or discharged by the currents $I_1$, $I_2$ and $I_3$, stabilizes under the following conditions:

$$\alpha+\beta=1$$

α: duty ratio of detection voltage pulse

β: duty ratio of referential voltage pulse

An operational amplifier 277 drives a transistor 501 through a resistor 502, with a charge voltage Vd, to control a voltage V2. The voltage V2 is fed back, as the output of the current detection circuit 26, to the output portion of the oscillator 11.

With the use of the above described control, the output voltage of the step-up transformer 15 is controlled so that the above described conditions are satisfied. As a result, the current which flows through the charge roller 2 is kept at a predetermined level.

As is evident from the above description, by setting the referential voltage $V_{ref1}$ and $V_{ref2}$ of the comparators 263 and 264, and the duty ratio β of the referential voltage pulse, at proper levels, respectively, the AC voltage applied to the charge roller 2 can be controlled so that the current which flows through the charge roller 2 stabilizes at an optional level.

At this time, how the charging apparatus in this embodiment operates as the current which flows through the charge roller 2 becomes instable, and the method for controlling the charging apparatus in such a situation, will be described with reference to FIG. 6.

Figure 6:
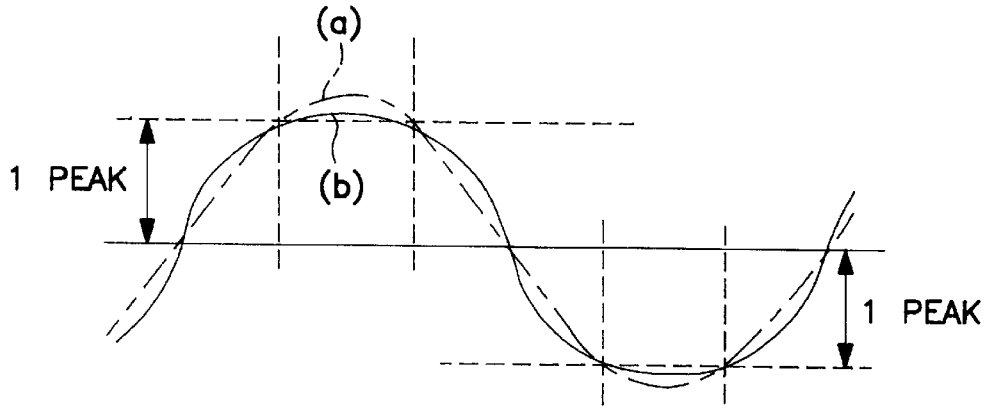
FIG. 6 is a drawing which depicts the operation of the current detection circuit.

FIG. 6 depicts the wave-form of the current, (a) representing a wave-form with no deformation, that is, a sinusoidal wave-form, whereas (b) representing a wave-form with a deformation caused by the change in the characteristics of the charge roller 2. In this embodiment, control is executed so that the length of the time, during which the current level is at a predetermined current level $V_{ref1}$ or higher, remains stable. More specifically, control is executed so that the peak value of the current becomes smaller when deformity occurs to the current wave-form than when no deformity occurs to the current wave-form Therefore, the amount of the increase in the effective value of the current caused by the presence of deformity in the current wave-form, is minimized.

In other words, according to this embodiment, the values of the referential voltages $V_{ref1}$ and $V_{ref2}$ are set in consideration of the degree of the deformity in the current wave-form caused by the change in the characteristics of the charge roller 2, so that the change in the effective value of the current is minimized. Therefore, the charging conditions are optimized regardless of the change in the characteristics of the charge roller 2.

Figure 7:
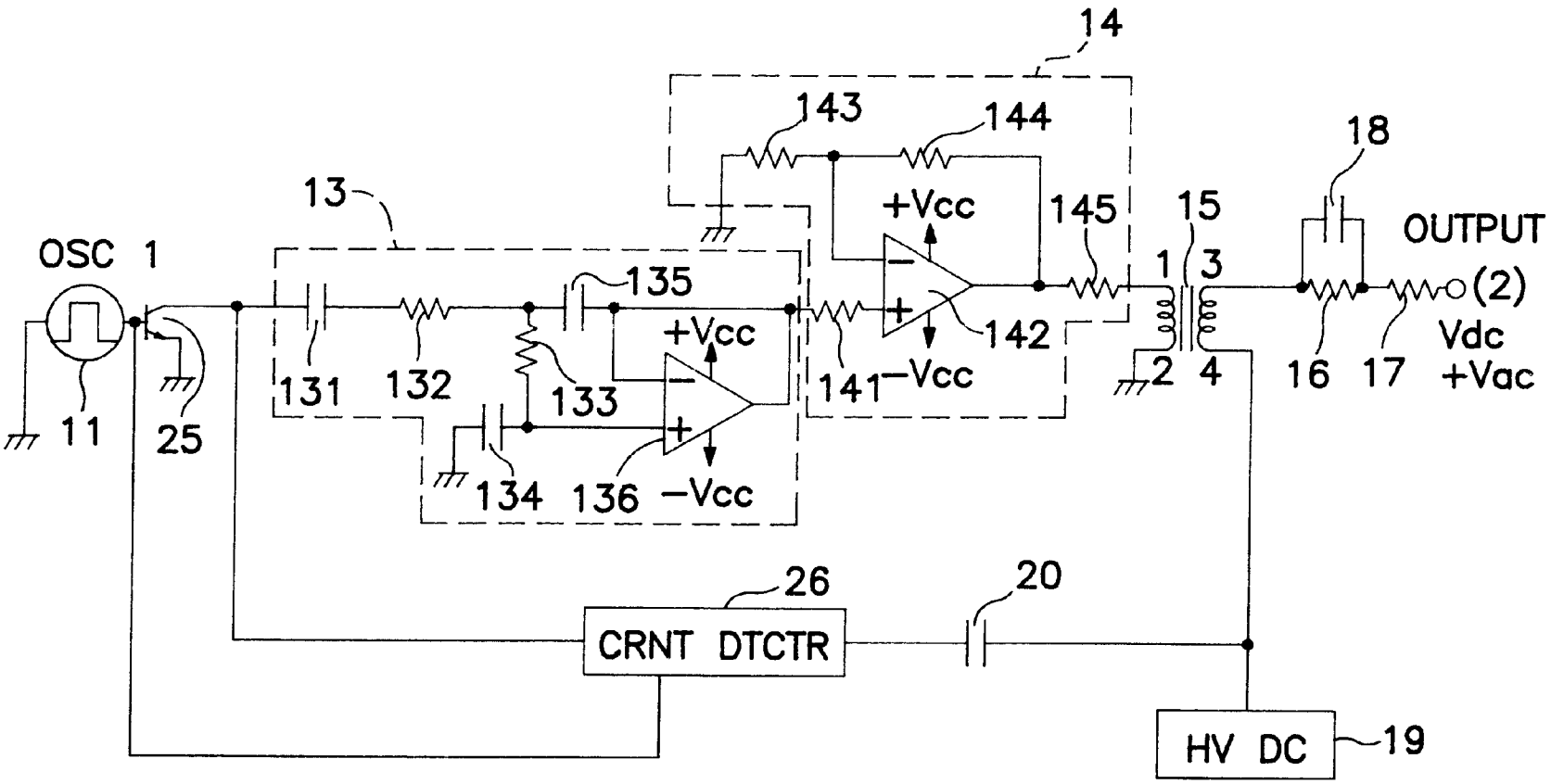
FIG. 7 is a diagram of the circuit for controlling the AC voltage applied to the charge roller in the second embodiment.
Figure 8:
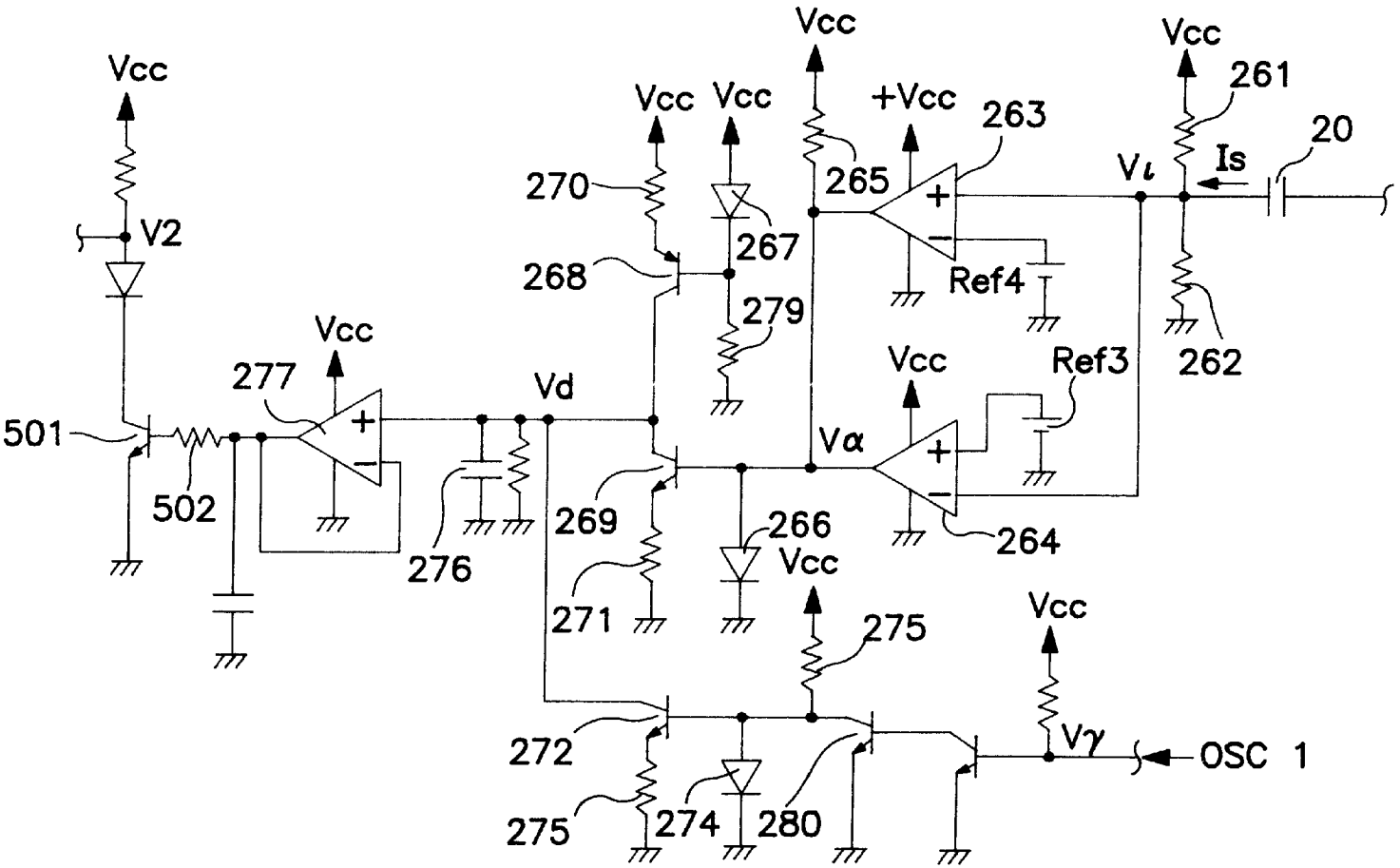
FIG. 8 is a diagram of the current detection circuit.
Figure 9:
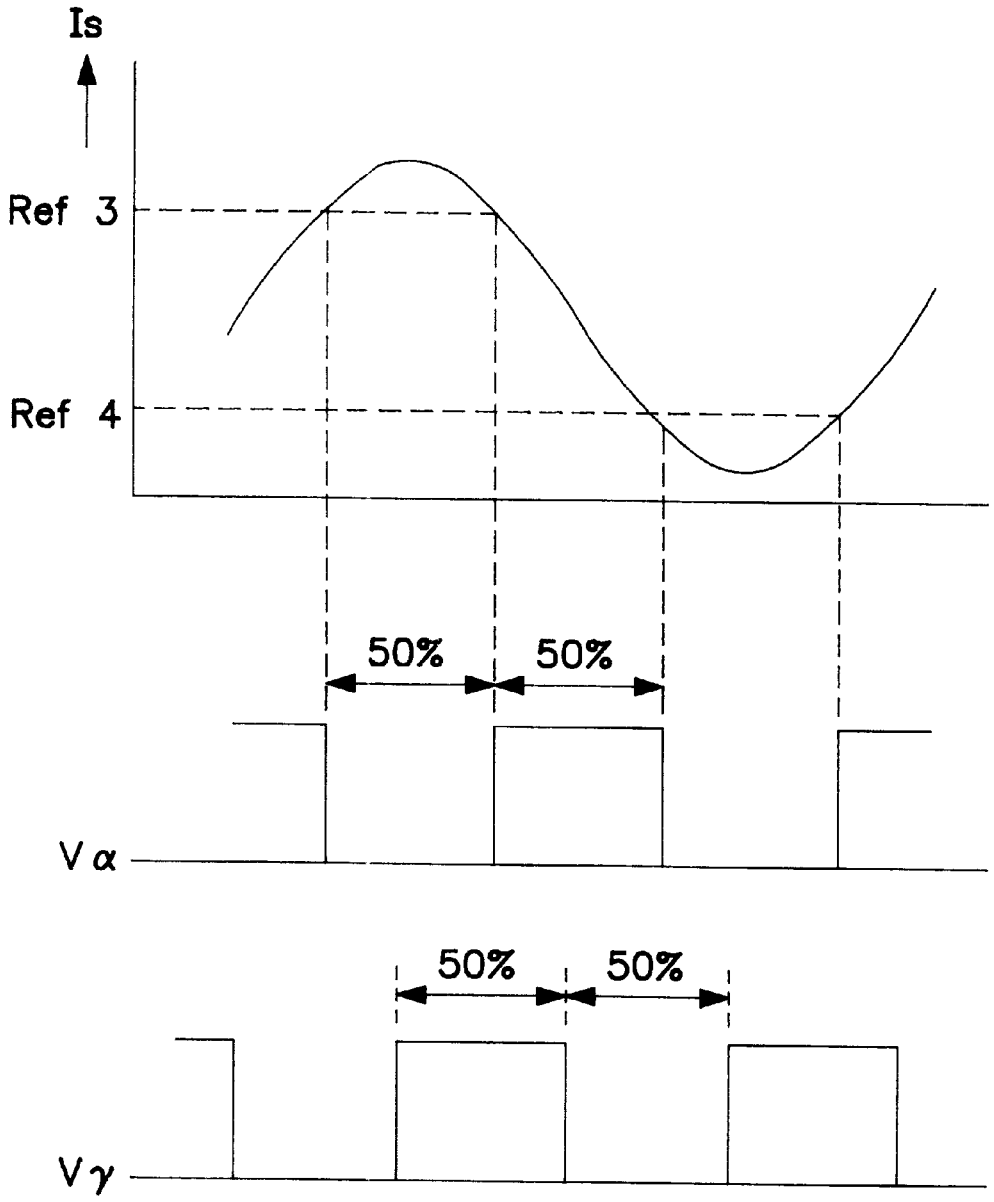
FIG. 9 is a time chart for the current detection circuit.

Embodiment 2 (FIGS. 7–9)

Figure 4:
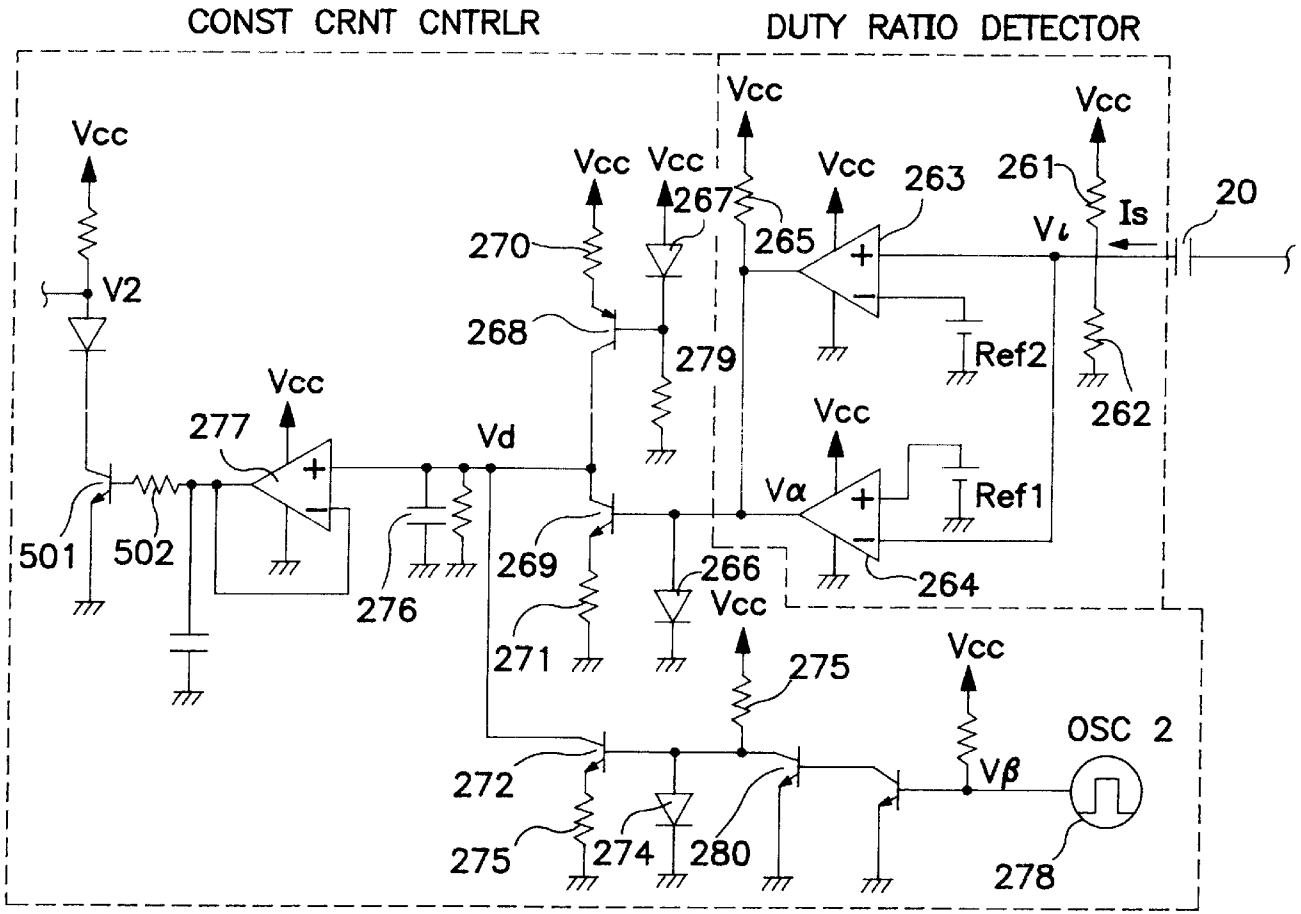
FIG. 4 is a diagram of the current detection circuit.

In the case of the first embodiment described above, the current which flows through the charge roller 2 is stabilized by comparing the detection pulse Vα obtained by converting the AC current which flows through the charge roller 2, with the duty ratio of the referential pulse Vβ generated by the oscillator OSC2 (FIG. 4).

In comparison, this embodiment is characterized in that a voltage with a rectangular wave-form with the same frequency as that of the AC voltage applied to the charge roller 2, that is, the voltage generated by the oscillator OSC1 (FIG. 3) in the first embodiment, is used as the referential pulse for stabilizing the current flow through the charge roller 2.

The control circuit in this embodiment will be described with reference to FIGS. 7 and 8. In these drawing, the structural components and portions which are the same as those of the control circuit illustrated in FIGS. 3 and 4 will be given the same referential characters as those in FIGS. 3 and 4. FIG. 8 is the internal portion of the current detection circuit 26 in this embodiment. Into a transistor 280 into which the referential pulse is to be inputted, pulses with the same frequency as that of the AC voltage applied to the charge roller 2 are inputted as the referential pulses. In other words, the voltage with a rectangular wave-form outputted from the oscillator OSC1 (FIG. 7) is inputted into the transistor 280. Otherwise, the structure and operation of this circuit are the same as those in the first embodiment.

FIG. 9 is a time chart which shows the comparator input voltage V1, current detection pulse Vα, and referential pulse Vγ, in this state in which the circuit operation has stabilized and the current through the charge roller 2 has been stabilized. The referential pulse Vγ has a rectangular wave-form for generating a voltage with a sinusoidal wave-form to be applied to the charge roller 2, and therefore, its duty ratio is 50%.

Also in this embodiment, control is executed so that a condition $\alpha+\gamma=1$ is satisfied. Therefore, the circuit stabilizes in the state in which the duty ratio of the current detection pulse is 50%. FIG. 9 is a time chart in which the duty ratio of the detection pulse Vα is 50%.

As is evident from FIG. 9, by properly setting the referential voltage $V_{ref3}$ and $V_{ref4}$ for the comparators 264 and 263 (FIG. 8), the AC voltage applied to the charge roller 2 can be controlled so that the current flow through the charge roller 2 remains stable at an optional level.

By configuring the charging apparatus as described above, the amount of the increase, in the effective value of the current, caused by the occurrence of deformity to the current is minimized.

Figure 10:
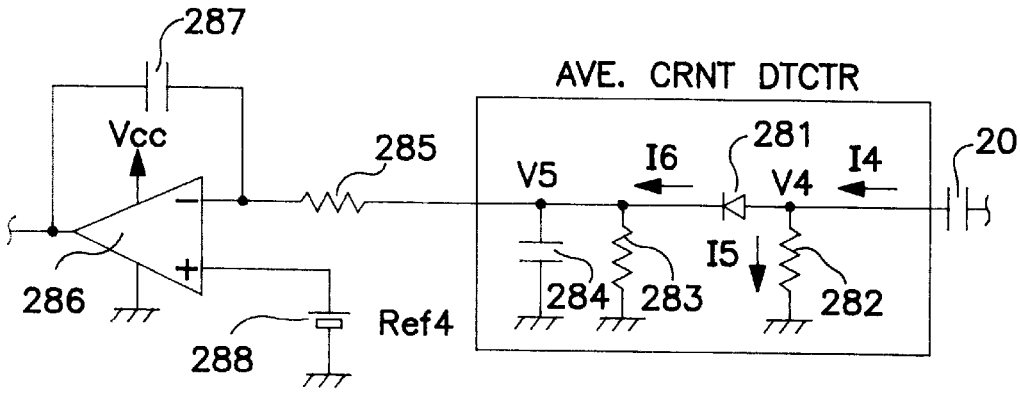
FIG. 10 is a diagram of the current detection circuit.
Figure 11:
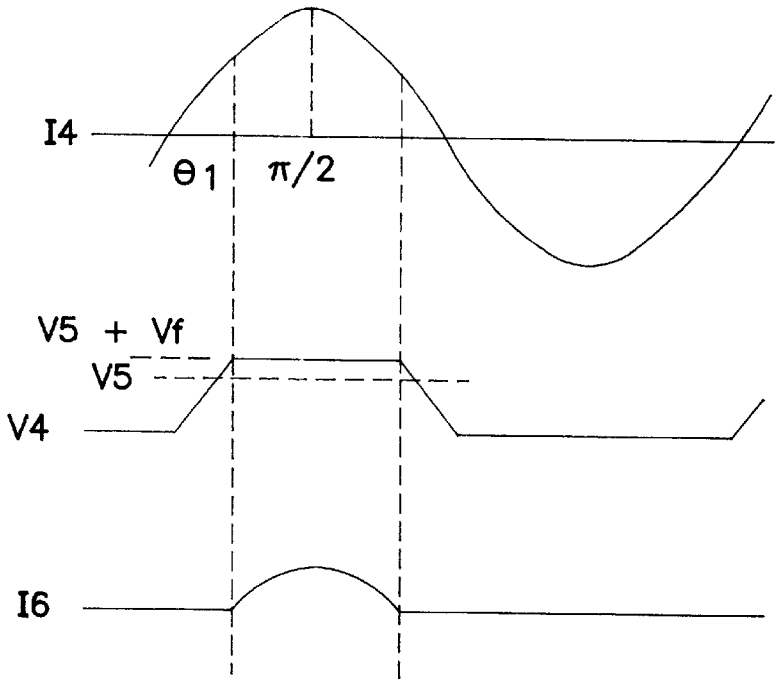
FIG. 11 is a time chart for the current detection circuit in the third embodiment.

Embodiment 3 (FIGS. 10 and 11)

In the cases of the first and second embodiments described above, the duty ratio, at which the amount of the current caused to flow through the charge roller 2 by the AC voltage applied to the charge roller 2 remains within a predetermined range, is detected, and the voltage applied to the charge roller 2 is controlled based on the detected duty ratio, so that the current flow through the charge roller 2 remains stable In comparison, this embodiment is characterized in that the average value of the current flowed through the charge roller 2 by the AC voltage applied to the charge roller 2 is detected, and the AC voltage applied to the charge roller 2 is controlled on the basis of the detection so that the current flow through the charge roller 2 remains stable.

The control circuit in this embodiment is different from that in the first embodiment only in the current detection method; only the internal portion of the current detection circuit is different from that in the current detection circuit 26 illustrated in FIG. 3. The current detection circuit 26 in this embodiment will be described with reference to FIGS. 10 and 11.

First, referring to FIG. 10, the input current 14 inputted into the current detection circuit 16 is divided into a current $I_5$ and a current $I_6$. The current $I_6$ is used to charge a smoothing capacitor 284 through a diode 281. FIG. 11 is a time chart which shows the input current 14 and the output current $I_6$.

As shown in FIG. 11, the current $I_6$ is unilaterally rectified by the function of the diode 281. A resistor 283 is a smoothing capacitor for discharge, and its resistance value is set to be sufficiently large compared to its capacity. The current $I_6$ is converted into a DC current with a voltage value of $V_5$ by the smoothing capacitor 284.

The voltage value $V_5$ is calculated by the following formula:

$$V_5=R283\times I_6(AV) \quad (1)$$

$I_6$ (AV): time-average value of current $I_6$

R283: resistance value of resistor 283

This voltage value $V_5$ is a value correspondent to the average value of the input current $I_4$, that is, the average value of the charging current.

The voltage value $V_5$ is compared to a predetermined voltage $V_{ref4}$, and is outputted as the output of the current detection circuit 26, by an operational amplifier 286.

The output is fed back to the output portion of the device which outputs the voltage with the rectangular wave-form, to control the voltage applied to the charge roller 2, so that the current through the charge roller 2 reins stable.

At this time, the relationship between the time average value $I_6$ (AV) and the input current $I_4$ will be described.

There are the following relationships between the time average value (AV) of the current $I_6$ (AV) and the value of the input current $I_4$:

$$V_4=V_5+Vf \quad (2)$$

$$I_6=I_4-v_4/R283 \quad (3)$$

$V_4$: voltage on the anode side of the diode 281

Vf: forward voltage of the diode 281

R283: resistance value of the resistor 283

Also, as is evident from FIG. 11, there is the following relationship:

$$I_6(AV)=\int_\theta^{\pi/2} I_6 d\theta \times 1/\pi \quad (4)$$

θ1; phase of input current when diode 281 turns on.

Based on the mathernationl formulas (1)–(4), by adjusting the voltage $V_5$ to a proper level by properly setting the values of the resistors 282 and 283, and the referential voltage $V_{ref4}$, the average value of the current which flows through the charge roller 2 can be kept stable at an optional level.

As is evident from the description of the embodiment given above, according to this embodiment, the average value of the current which flows through the charge roller 2 is detected, and the charge voltage is controlled based on the detected current value, so that the current through the charge roller 2 remains stable. Therefore, even if a deformity occurs to the wave-form of the charge current, the effective value of the charge current is kept substantially stable.

Obviously, the choices of a contact type charging member do not need to be limited to the charge rollers in the preceding embodiments. The form, material, and configuration for a charge roller are optional; a charge roller may be of a blade type, a pad type, a rod type, a block type, a wire type, or a brush type.

The wave-form of the oscillating component of the oscillating voltage (alternating voltage) is optional; it may be minusoidal, rectangular, triangular, or the like. Further, the oscillating voltage may be such a voltage with a rectangular wave-form that is generated by periodically turning on and off a DC voltage power source. In other words, any voltage can be used as the oscillating component for the oscillating voltage as long as its level periodically changes.

It is also obvious that the image formation principle and process of an image forming apparatus does not need to be electrophotographic.

While the invention has been described with reference to the structures disclosed herein, it is not confined to the details set forth and this application is intended to cover such modifications or changes as may come within the purposes of the improvements or the scope of the following claims.

What is claimed is:

1. A charging apparatus comprising:

a charging member for charging a member to be charged;

voltage application means for applying an oscillating voltage to said charging member;

current detecting means for detecting an electric current flowing through said charging member;

time detecting means for detecting time during which an output level of said current detecting means is not less than a predetermined level; and voltage control means for controlling an oscillating component of the voltage applied to said charging member on the basis of an output of said time detecting means.

2. An apparatus according to claim 1, wherein said voltage control means controls the oscillating component so that the output of said time detecting means is substantially constant.

3. An apparatus according to claim 1, wherein said voltage control means forms a pulse wave form with high and low level depending on whether the output of said time detecting means is within a predetermined range or not.

4. An apparatus according to claim 3, wherein said voltage control means controls the oscillation component on the basis of comparison between a pulse signal of the pulse wave form and a reference signal.

5. An apparatus according to claim 1, wherein said current detecting means detects an average of the current through said charging member.

6. An apparatus according to claim 1, wherein the member to be charged has a photosensitive layer, and said charging member substantially uniformly the member to be charged.

7. An apparatus according to claim 6, wherein said charging means is used in an image forming apparatus having exposure means for exposing the member to be charged to image light.

8. An apparatus according to claim 1, wherein the charging member is contacted to the member to be charged.

* * * * *

UNITED STATES PATENT AND TRADEMARK OFFICE

CERTIFICATE OF CORRECTION

PATENT NO. : 6,278,103 B1
DATED : August 21, 2001
INVENTOR(S) : Hiroshi Takami

It is certified that error appears in the above-identified patent and that said Letters Patent is hereby corrected as shown below:

Title page,
Item [57], ABSTRACT, line 4, "currant" should read -- current --.

Column 1,
Line 19, "process" should read -- process. --; and
Line 58, "maser," should read -- member --.

Column 3,
Line 48, "stable" should read -- stable, --.

Column 4,
Line 6, "curve On" should read -- curve. On --;
Line 12, "Is" should read -- is --; and
Line 13, "stable" should read -- stable. --.

Column 5,
Line 31, "drum This" should read -- drum. This --.

Column 7,
Line 56, "LOW" should read -- Low --.

Column 9,
Line 11, "wave-form Therefore," should read -- wave-form. Therefore --.

Column 10,
Line 62, "reins" should read -- remains --.

UNITED STATES PATENT AND TRADEMARK OFFICE

CERTIFICATE OF CORRECTION

PATENT NO. : 6,278,103 B1
DATED : August 21, 2001
INVENTOR(S) : Hiroshi Takami

It is certified that error appears in the above-identified patent and that said Letters Patent is hereby corrected as shown below:

Column 11,
Line 3, "$I_6$=$I_4$ - $V_4$/R283" should read -- $I_4$ -$V_4$/R283 --; and
Line 36, "minusoidal," should read -- sinusoidal, --.

Signed and Sealed this

Seventh Day of May, 2002

*Attest:*

*Attesting Officer*

JAMES E. ROGAN
*Director of the United States Patent and Trademark Office*